US006228041B1

(12) United States Patent
Ameer

(10) Patent No.: US 6,228,041 B1
(45) Date of Patent: May 8, 2001

(54) LIGHTWEIGHT, PORTABLE, SCALP-VIBRATING AND HAIR GROWTH STIMULATING DEVICE

(76) Inventor: Mark J. Ameer, 1079 N. Washington St., Pottstown, PA (US) 19464-4051

( * ) Notice: Subject to any disclaimer, the term of this patent is extended or adjusted under 35 U.S.C. 154(b) by 0 days.

(21) Appl. No.: 09/218,707

(22) Filed: Dec. 22, 1998

(51) Int. Cl.[7] ..... A61H 1/00

(52) U.S. Cl. ..... 601/58; 601/46; 601/56; 601/57

(58) Field of Search ..... 601/46, 49, 56–60, 601/67, 69, 70, 71, 79, 65, 136, 78, 82, 84, 89, 95, 97; 2/171.2, 181

(56) References Cited

U.S. PATENT DOCUMENTS

| | | | | |
|---|---|---|---|---|
| 3,019,785 | * | 2/1962 | Eiden | 601/58 |
| 3,068,858 | * | 12/1962 | Suarez | 601/58 |
| 3,727,607 | * | 4/1973 | Dill | 601/57 |
| 3,831,591 | * | 8/1974 | Newkirk | 601/58 |
| 4,469,092 | * | 9/1984 | Marshall et al. | 601/70 |
| 4,506,659 | * | 3/1985 | Chester | 601/97 |
| 4,765,316 | * | 8/1988 | Marshall | 601/70 |
| 4,979,502 | * | 12/1990 | Hunt | 601/15 |
| 5,158,075 | * | 10/1992 | Howard | 601/79 |
| 5,337,420 | * | 8/1994 | Haysom et al. | 2/181 |
| 5,421,799 | * | 6/1995 | Rabin et al. | 601/46 |
| 5,486,156 | * | 1/1996 | Takach | 601/46 |
| 5,557,807 | * | 9/1996 | Hujar et al. | 2/171.2 |
| 5,605,144 | * | 2/1997 | Simmons et al. | 2/171.2 |

FOREIGN PATENT DOCUMENTS

| | | | | |
|---|---|---|---|---|
| 3633092 | * | 1/1988 | (DE) | 601/57 |

* cited by examiner

*Primary Examiner*—Justine R. Yu
(74) *Attorney, Agent, or Firm*—Joseph M. Konieczny; John F. A. Earley, III; Harding, Earley, Follmer & Frailey

(57) ABSTRACT

A lightweight, portable, hair-growth stimulator fixed to and disguised within a fashion hat. The scalp stimulator includes a vibrator capable of being powered by a portable direct current power source. Agitators are connected to the vibrator and are immersed within a vibration medium which is contained in a pliable bladder. The stimulator can be worn inconspicuously by a patient with great freedom as to time, manner, and place.

19 Claims, 2 Drawing Sheets

LIGHTWEIGHT, PORTABLE, SCALP-VIBRATING AND HAIR GROWTH STIMULATING DEVICE

FIELD OF THE INVENTION

The present invention relates to a lightweight, portable, scalp-vibrating and hair-growth stimulating device. The invention also relates to a method of inconspicuously wearing a portable hair-growth stimulating device while going about one's day-to-day business.

BACKGROUND OF THE INVENTION

Baldness is a problem which affects millions of people in the United States. A wide variety of solutions such as hair transplants, hair implants and drug therapy are widely used to correct or mitigate the effects of baldness. Surgical techniques such as hair transplants and hair implants are costly, painful and produce an unnatural appearance. Drug therapy, such as Rogain® (registered trademark of Johnson & Johnson) is also costly and produces undesirable side effects such as unwanted growth on parts of the body other than the head.

A known alternative method of stimulating hair growth involves massaging or in other ways stimulating the human scalp. It is generally well recognized that massage or stimulation increases blood flow to the scalp which, in turn, stimulates hair growth and reduces flaking and peeling of the scalp.

In the prior art, many inventors have recognized the benefits derived from stimulating or massaging the human scalp. Prior art massage devices are taught, for example, in U.S. Pat. Nos. 3,763,853, 4,469,092, 4,765,316, 5,421,799, and 5,486,156. The devices disclosed in each of the aforementioned patents have complex and costly designs. Such designs are prone to mechanical failure and are not affordable to the average consumer. Therefore, it would be desirable to provide a hair-growth stimulating device which is very inexpensive and which has a simple, reliable design.

The devices disclosed in the prior art are also bulky, require the user to remain stationary while wearing the device, and severely restrict the user's activities. Such bulky and restrictive designs deter regular use of the device which is necessary to achieve the benefits derived from stimulation of the scalp. Therefore, it is desirable to provide a lightweight and portable hair-growth stimulating device which is comfortably worn by the user in his day-to-day activities.

While some of the head massaging devices disclosed in prior art may be portable, such devices are very conspicuous and cause embarrassment to the user. Therefore, it is also desirable to provide a portable hair-growth stimulating device which is concealed from public view and inconspicuous when worn by the user.

SUMMARY OF THE INVENTION

The present invention provides a scalp vibrating and hair-growth stimulator which is very inexpensive and which has a simple, reliable design. The stimulator is comfortably worn by the user in his day-to-day activities, is concealed from public view, and is inconspicuous when worn by the user.

The lightweight, portable, hair-growth stimulator comprises a fashion hat and a scalp vibrator fixed to and concealed within the fashion hat. The vibrator is powered by a portable direct current power source. The vibrator has a pliable bladder containing a vibration medium, and at least one agitator connected to a vibrating motor immersed within the vibration medium.

The fashion hat is preferably made of a soft, pliable, fabric. The fashion hat may be selected from the group consisting of a baseball hat, cowboy hat, derby, bowler, or beret or the like. Alternatively, the hat may be rigid such as a helmet or hard hat.

The vibrator comprises an electric motor having top and bottom surfaces, front and back surfaces, left and right side surfaces, and an oscillator extending outwardly from the front surface. The vibrator includes a rechargeable power source.

The agitators preferably are made of a rigid material such as metal wire or hard plastic. One end of the agitators is fixed to the oscillator on the front surface of the vibrating motor. The agitators extend outwardly from the front surface, downwardly toward the bottom surface, and rearwardly parallel to the bottom surface to support the weight of the motor. The agitators have a curved contour similar to the contour of a human head.

The bladder is made of a breathable, washable, lightweight fabric such as cotton or polyester. The bladder is preferably removably fixed to the interior of the hat using releasable fasteners such as Velcro tabs or snaps. The bladder may include a removable cover.

The vibration medium comprises small beads such as generally-spherical polypropylene beads having an average diameter of about 3 mm. The vibrating motor and agitators are immersed within the vibration medium.

The present invention also provides a novel method of stimulating hair growth on the head of a human. Initially, the above-described lightweight, portable, scalp stimulator is provided. The user selects a hat within which to contain and conceal the scalp vibrator. The user removably fixes the scalp vibrator within the hat and places the hat on his or her head. The user energizes the scalp vibrator and wears the hat for a period of time while conducting everyday activities.

DETAILED DESCRIPTION OF PREFERRED EMBODIMENTS

Figure 1:
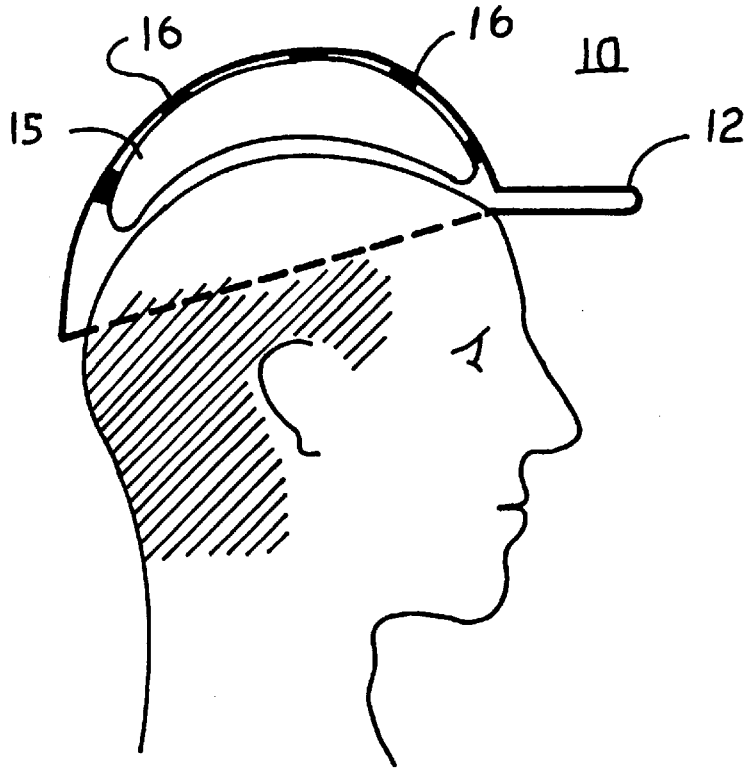
FIG. 1 is a side elevation in partial section of a patient wearing the scalp vibrating and hair-growth stimulator 10 in accordance with an embodiment of the invention.

The lightweight, portable, hair-growth stimulator, designated generally by reference numeral 10, is illustrated with reference to FIGS. 1–4 wherein like reference numerals are used throughout to designate like elements.

The hair growth stimulator 10 comprises a scalp vibrator 14 fixed to and concealed within a fashionable hat 12 as seen in FIG. 1. The scalp vibrator 14 is preferably removable fixed within the hat 12 by releasable fasteners 16 such as Velcro® tabs or snaps. The scalp vibrator 14 can be utilized within a variety of fashionable hats such as a baseball hat, cowboy hat, bowler, derby, or the like, or non-fashion head gear such as a helmet or hard hat.

Figure 2:
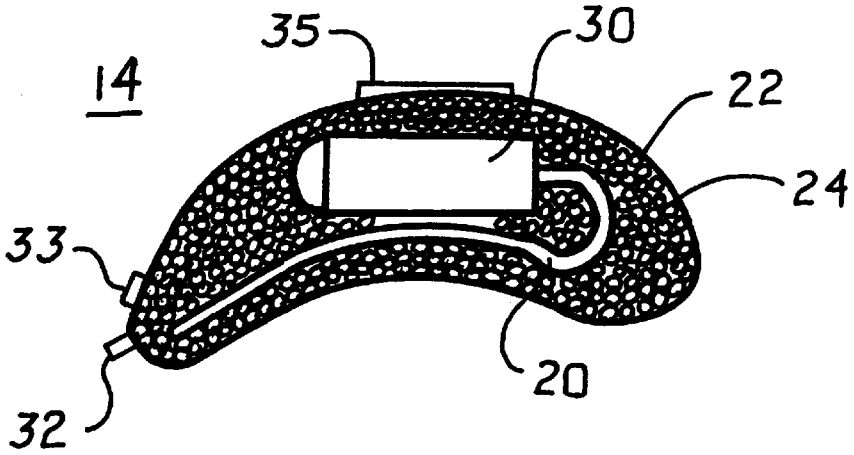
FIG. 2 is an enlarged side elevation in partial section of the scalp vibrator 14 illustrated in FIG. 1.

The scalp vibrator 14 comprises a vibrating motor 30 having a plurality of agitators 20 fixed to and extending therefrom. The vibrating motor 30 and agitators 20 are immersed within a pliable bladder 22 containing a vibration medium 24. A sectional side elevation of the vibrator 14 is shown in FIG. 2. In the embodiment illustrated in FIGS. 1–4, the vibrating motor 30 comprises a small electric motor having an oscillator 28 extending outwardly from the front surface 30*a*.

Figure 3:
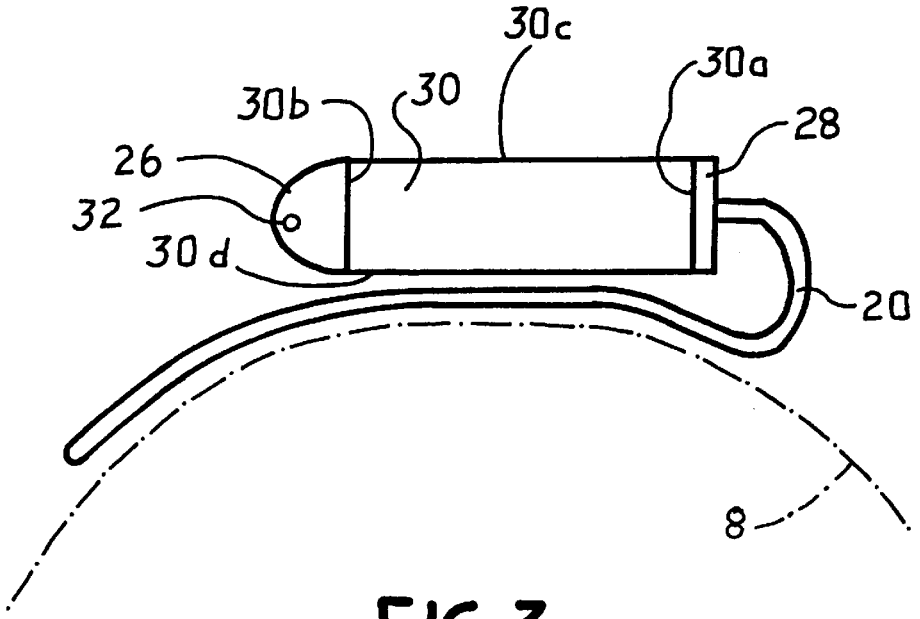
FIG. 3 is an enlarged, side elevation of the vibrating motor 30 and agitator 20 shown in FIG. 2 relative to the contour of a human scalp 8 (shown in phantom lines); and, FIG. 4 is a top plan view of the vibrating motor 30 and agitator 20 shown in FIG. 3.
Figure 4:
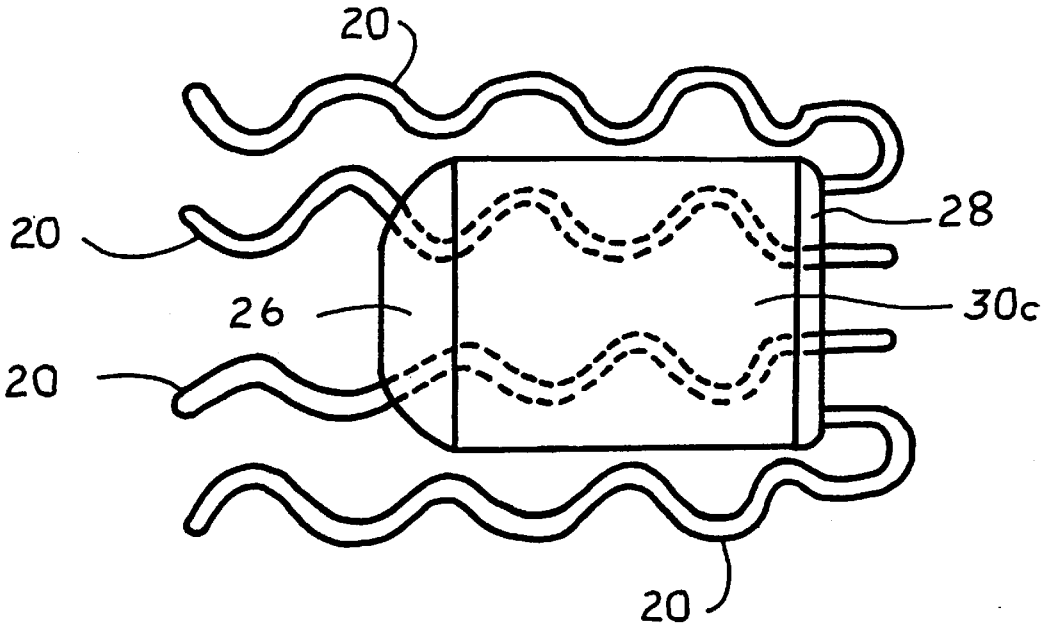

The motor 30 is preferably powered by direct current. Referring to FIGS. 3 and 4, the motor has a rechargeable direct current battery pack 26 fixed to the back surface 30*b* of the motor. The battery pack 26 is connected to an outlet 32 on the outside of the bladder to which a charging source of direct current may be attached or an alternative source of direct current. For example, the motor may be powered from an automobile lighter adapter and charged by transformed household current. The rechargeable battery pack 26 may comprise, for example, rechargeable nickel cadmium battery cells. The motor is also connected to an on/off switch 33 on the outside of the bladder.

A plurality of agitators 20 are fixed to the oscillator 28 as best seen in FIGS. 3 and 4. The agitators 20 preferably comprise a rigid material such as metal wire or hard plastic having a diameter of about 3 mm. The agitators 20 extend outwardly approximately 8 cm. from the front surface 30*a* of the motor 30, downwardly toward the bottom surface 30*d* of the motor, and then rearwardly about 20 cm. parallel to the bottom surface 30*d* of the motor 30 as best seen in FIG. 3. The free end portion of the agitators 20 have a curved contour conforming to the contour of a human head 8 shown in phantom lines in FIG. 3. Referring to FIG. 3, the device has four agitators 20 although a different number may be provided depending on the size and shape of the bladder 22.

Referring to FIG. 2, the vibrating motor 30 and agitators 20 are immersed within a vibration medium 24 which is contained within the pliable bladder 22. The bladder 22 is made of a lightweight, breathable, washable, pliable fabric such as cotton, polyester or the like. The bladder 22 preferably has a sealable access slot 35 for removing or replacing the vibrating motor 30 or vibration medium 24. The bladder may also have a fabric cover 15 which is easily removed for washing.

The vibration medium 24 preferably comprises plastic beads such as generally-spherical polypropelene or hard rubber beads. Preferably, the diameter of the beads is about 3 mm.

The motor 30 rapidly oscillates the agitators 20 which causes the surrounding beads to vibrate.

This vibration is transmitted throughout the bladder 22 by the beads and ultimately to the scalp of the patient. Since the bladder 22 is pliable, the bladder 22 shapes itself in conformity with the contour of the patient's head, thereby insuring contact of the bladder 22 with a large surface portion of the patient's head. The weight of the motor 30, and beads above the agitators 20, forces the agitators 20 downwardly in contact with the lower beads and the patient's head.

In the method of the present invention, the patient initially selects a fashionable hat or non-fashion head wear in which to insert the vibrator 14 described above. Since the scalp vibrator 14 is releasably inserted into the hat 12, the patient may routinely change the hat 12 containing the scalp vibrator 14.

After inserting the scalp vibrator 14 into the selected hat 12, the patient simply places the stimulator 10 on his head, energizes the vibrating motor 30 and wears the stimulator 10 for a stimulating session of about 15 to 30 minutes. Since the stimulator 10 is portable and lightweight, the patient may go about his or her everyday activities with little inhibition from the stimulator 10. As a result, the patient is encouraged to wear the stimulator 10 much more often than prior art devices, thereby increasing the beneficial aspects of the stimulator 10. Since the stimulator 10 is disguised as a fashionable hat 14, the patient has great freedom as to the time, manner, and place for wearing the stimulator 10.

What is claimed is:

1. A lightweight, portable, hair-growth stimulator, comprising:

a) a hat; and, b) a scalp vibrator fixed to and concealed within said hat, said scalp vibrator having:

i) a vibrating motor capable of being powered by direct current;

ii) portable direct current power source connected to said vibrating motor;

iii) a pliable bladder which conforms to the contour of a human scalp when resting thereon, said bladder containing a vibration transmitting medium;

iv) an agitator connected to said vibrating motor and immersed within said vibration transmitting medium, said vibration transmitting medium transmitting and propagating vibrations from said agitator throughout said bladder.

2. The stimulator recited in claim 1, said hat being made of a soft, pliable, fabric.

3. The stimulator recited in claim 2, said hat comprising a fashion hat selected from the group consisting of a baseball hat, cowboy hat, derby, bowler, or beret.

4. The stimulator recited in claim 1, said hat comprising non-fashion head wear including a helmet or hard hat.

5. The stimulator recited in claim 1, said vibrating motor having top and bottom surfaces, front and back surfaces, left and right side surfaces, and an oscillator extending outwardly from said front surface.

6. The stimulator recited in claim 5, said vibrating motor having a plurality of agitators having one free end and one end fixed to said oscillator.

7. The stimulator recited in claim 6, said agitators comprising rigid metal wire or hard plastic.

8. The stimulator recited in claim 6, said agitators extending outwardly from said front surface, downwardly toward said bottom surface, and rearwardly parallel to said bottom surface supporting the weight of the motor.

9. The stimulator recited in claim 8, said agitators having a curved contour similar to the contour of a human head.

10. The stimulator recited in claim 1, said vibrator including a rechargeable power source.

11. The stimulator recited in claim 1, said bladder comprising a breathable, washable, lightweight fabric including cotton or polyester.

12. The stimulator recited in claim 1, said vibration medium comprising generally-spherical beads.

13. The stimulator recited in claim 12, said vibration transmitting medium comprising polypropylene beads having an average diameter of about 3 mm.

14. The stimulator recited in claim 1, said bladder being removably fixed to the interior of said hat using releasable fasteners including Velcro tabs or snaps.

15. The stimulator recited in claim 1, said vibrating motor being immersed within said vibration transmitting medium.

16. The stimulator recited in claim 1, said bladder including a removable cover.

17. The stimulator recited in claim 1, said bladder including a resealable access slot.

18. A lightweight, portable, hair-growth stimulator, comprising:

a) a hat; and, b) a scalp vibrator fixed to and concealed within said hat, said scalp vibrator having:

i) a vibrating motor capable of being powered by direct current;

ii) portable direct current power source connected to said vibrating motor;

iii) a pliable bladder which conforms to the contour of a human scalp when resting thereon, said bladder containing a vibration transmitting medium;

iv) an agitator connected to said vibrating motor and immersed within said vibration transmitting medium, said vibration transmitting medium transmitting and propagating vibrations from said agitator throughout said bladder;

said hat being made of a soft, pliable, fabric;

said hat comprising a fashion hat selected from the group consisting of a baseball hat, cowboy hat, derby, bowler, or beret;

said vibrating motor having top and bottom surfaces, front and back surfaces, left and right side surfaces, and an oscillator extending outwardly from said front surface;

said vibrator including a rechargeable power source;

said vibrating motor having a plurality of agitators having one free end and one end fixed to said oscillator;

said agitators comprising rigid metal wire or hard plastic;

said agitators extending outwardly from said front surface, downwardly toward said bottom surface, and rearwardly parallel to said bottom surface supporting the weight of the motor;

said agitators having a curved contour similar to the contour of a human head;

said bladder comprising a breathable, washable, lightweight fabric such as cotton or polyester;

said vibration transmitting medium comprising generally-spherical beads;

said vibration transmitting medium comprising polypropylene beads having an average diameter of about 3 mm;

said bladder being removably fixed to the interior of said hat using releasable fasteners including Velcro tabs or snaps;

said vibrating motor being immersed within said vibration transmitting medium;

said bladder including a removable cover; and, said bladder including a resealable access slot.

19. A method of stimulating hair growth on the head of a human, comprising the steps of:

a) providing a lightweight, portable, scalp vibrator which can be fixed to and concealed within a fashion hat, said scalp vibrator comprising:

i) a vibrating motor capable of being powered by direct current;

ii) a rechargeable, portable direct current power source connected to said vibrating motor;

iii) a pliable bladder which conforms to the contour of a human scalp when resting thereon, said bladder containing a vibration transmitting medium;

iv) an agitator connected to said vibrating motor and immersed within said vibration transmitting medium, said vibration medium transmitting and propagating vibrations from said agitator throughout said bladder;

b) selecting a hat within which to conceal the scalp stimulator and fixing the scalp stimulator within said hat;

c) placing said hat on the head;

d) energizing said scalp vibrator;

e) wearing said hat while conducting everyday activities.

* * * * *